United States Patent [19]

Ting

[11] Patent Number: 5,048,248

[45] Date of Patent: Sep. 17, 1991

[54] NON-DIRECTIONAL COMPOSITE FOAM PANEL SIDE JOINT

[76] Inventor: Raymond M. L. Ting, 318 Holiday Dr., Pittsburgh, Pa. 15237

[21] Appl. No.: 370,133

[22] Filed: Jun. 20, 1989

Related U.S. Application Data

[63] Continuation-in-part of Ser. No. 336,739, Apr. 12, 1989.

[51] Int. Cl.[5] ..... E04C 1/00

[52] U.S. Cl. ..... 52/309.9; 52/459; 52/465; 52/468

[58] Field of Search ..... 52/309.3, 309.9, 459, 52/460, 461, 465, 468, 469, 470

[56] References Cited

U.S. PATENT DOCUMENTS

| | | | |
|---|---|---|---|
| 3,289,370 | 12/1966 | Van Etten | 52/309 |
| 3,331,174 | 7/1967 | Wesch et al. | 52/309 |
| 3,364,642 | 1/1968 | Blickman | 52/403 |
| 3,471,187 | 1/1968 | Riseborough . | |
| 3,481,642 | 12/1969 | Bonallack et al. . | |
| 3,535,844 | 10/1970 | Glaros . | |
| 3,594,028 | 7/1971 | Scott . | |
| 3,775,921 | 12/1973 | Avera . | |
| 3,783,174 | 1/1974 | Lindgren . | |
| 3,851,434 | 12/1974 | Boyd . | |
| 3,854,261 | 12/1974 | Frei . | |
| 3,868,802 | 3/1975 | Schubach . | |
| 3,949,529 | 4/1976 | Porter . | |
| 4,196,554 | 4/1980 | Anderson et al. | 52/309.9 X |
| 4,228,629 | 10/1980 | Chalmers et al. . | |
| 4,671,038 | 6/1987 | Porter . | |

*Primary Examiner*—David A. Scherbel
*Assistant Examiner*—Creighton Smith
*Attorney, Agent, or Firm*—Limbach, Limbach & Sutton

[57] ABSTRACT

A building panel assembly comprising two or more individual panel members. The panel members in turn are comprised of an outer metal facing sheet forming an exterior panel surface, an inner metal facing sheet forming an interior panel surface and a structural foam core. Once the individual panel members are secured to a structural support, a foam plug is inserted between the panel members to enhance the insulated properties of the assembly.

21 Claims, 2 Drawing Sheets

NON-DIRECTIONAL COMPOSITE FOAM PANEL SIDE JOINT

RELATED APPLICATIONS

This application is a continuation-in-part of U.S. application Ser. No. 07/336,739 filed on Apr. 12, 1989.

TECHNICAL FIELD OF THE INVENTION

This invention relates to the general field of composite wall or roof foam panels. These panels employ concealed fastening means used in conjunction with structural foam cores which are sandwiched between two facing metal skins.

BACKGROUND OF THE INVENTION

Composite foam panels have been widely used in the building of wall and roof structures due to their high strength to weight ratio and insulative properties. These panels generally range in thickness from one inch to eight inches, depending upon load and thermal insulation requirements. Such panels commonly are fabricated in widths ranging generally from twelve inches to forty-eight inches.

Composite foam panels are generally fastened to building frame members such as horizontal wall girts and roof purlins in a side by side fashion to form the wall or roof surface. Obviously, concealed fastening systems are preferred by architects in order to present a smooth exterior surface.

Concealed fastening systems are generally of two types. The first, commonly designated as a metal skin interlocking design employs interlocking male and female side joints which are profiled along the side edges of the metal skins. The interior side joint is offset from the side edge of the exterior skin giving open accessibility for applying fasteners from the exterior side of the panel. The fastening system is then concealed by the exterior panel surface of the adjacent panel upon side joint engagement. In this type of design, each panel is fastened to the building frame along one side and engaged along the other side. In order to facilitate ease of engagement, a side joint cavity is provided for hiding the fastening system and for providing clearance within the engaged side joints.

The major drawback of the metal skin interlocking side joint design of the prior art is that thermal leakage through the side joint is inevitable. This is due to the presence of the side joint cavity, relative side joint movement under load and the through-conductivity of the fastening system. As such, this type of design is not suitable where thermal efficiency is the primary design function such as in a refrigeration building design.

The second commonly employed configuration is known as the foam core interlocking side joint design. Interlocking tongue and groove elements are provided along the side edges of the foam core. Spaced apart metal straps with mechanical interlocking devices are buried within the foam core of the panel for tightly interlocking the side joints. The panels are fastened to the building frame from the interior side using rivets.

Thermal leakage through panels constructed employing the referenced foam core interlocking side joint design is minimal and, as such, this type of panel is widely used in the construction of refrigeration buildings. However, this design is not without its drawbacks. More specifically, high construction costs are incurred and, in addition, extremely rigid tolerance control must be exercised during erection. These panels also present potential water leakage problems due to the lack of shielded pressure equalized cavities while, often times, interior accessability is not available for driving the rivets. Obviously, high erection costs result which is a problem exacerbated by the need for split crews, one outside crew for handling and placing the panels and one inside crew for interlocking side joints and fastening the panels to the appropriate supports.

Prior art panel designs have also been found to be extremely difficult to replace in situations where individual panel members are damaged for it is difficult to dismount and reassemble the panels in light of the interlocking side joints and lack of accessibility to the concealed fasteners.

Thus, an object of the present invention is to provide building panel members and building panel assemblies which do not suffer from the disadvantages recited previously.

It is still a further object of the present invention to provide panel members and building panel assemblies which are easy to erect while displaying excellent insulative properties, are resistent to water penetration and which employ concealed fasteners.

These and further objects will be more readily appreciated when considering the following description and appended drawings, wherein:

FIG. 1 is a cross sectional view of the composite foam panel of the present invention, and FIG. 2 a cross sectional view of the installed composite foam panel side joint design of this invention.

SUMMARY OF THE INVENTION

The present invention is to a panel member and building panel assembly. The assembly comprises two or more individual panel members which individually comprise an outer metal facing sheet forming an exterior panel surface, an inner metal facing sheet forming an interior panel surface and a structural foam core.

The inner metal facing sheet is characterized as having a width of specific dimension defined by two parallel edges. The outer metal facing sheet is also characterized as having a width defined by two parallel edges which is less than the width of the inner metal facing sheet.

The structural foam core is characterized as having top and bottom surfaces adhesively connected to the outer metal and inner metal facing sheets. The structural foam core is further characterized by noting that the top surface is of a width substantially coincident with the width of the outer metal facing sheet while the bottom surface is of a width substantially coincident with the width of the inner metal facing sheet. As such, this structural foam core possesses sloping side walls.

The individual panel members are caused to abut substantially at the edges of the inner metal facing sheets. The panel members are placed upon a substantially planar support and attached thereto by securing means passing through the inner metal facing sheet in an area proximate the parallel edges thereof.

Once the panel members are secured to the planar support, a foam plug having a top surface and sloping side walls is frictionally caused to engage the sloping side walls of the structural foam cores of adjacent panel members.

An exterior joint cover is provided over the top surface of said foam plug and is sized to contact the outer metal facing sheets of adjacent panel members.

DETAILED DESCRIPTION OF THE INVENTION

It was the design goal of the present invention to provide a composite foam panel system having the following attributes:

(1) Easiness in replacing an individual panel of an installed panel assembly.

(2) Easiness of erecting a panel in a non-directional and non-sequential manner.

(3) Having a concealed fastening system which is applied from the building exterior.

(4) Displaying minimal thermal leakage from the side joint.

(5) Displaying watertight performance of the side joint.

(6) Displaying a forgiveness in erection tolerances.

Figure 1:
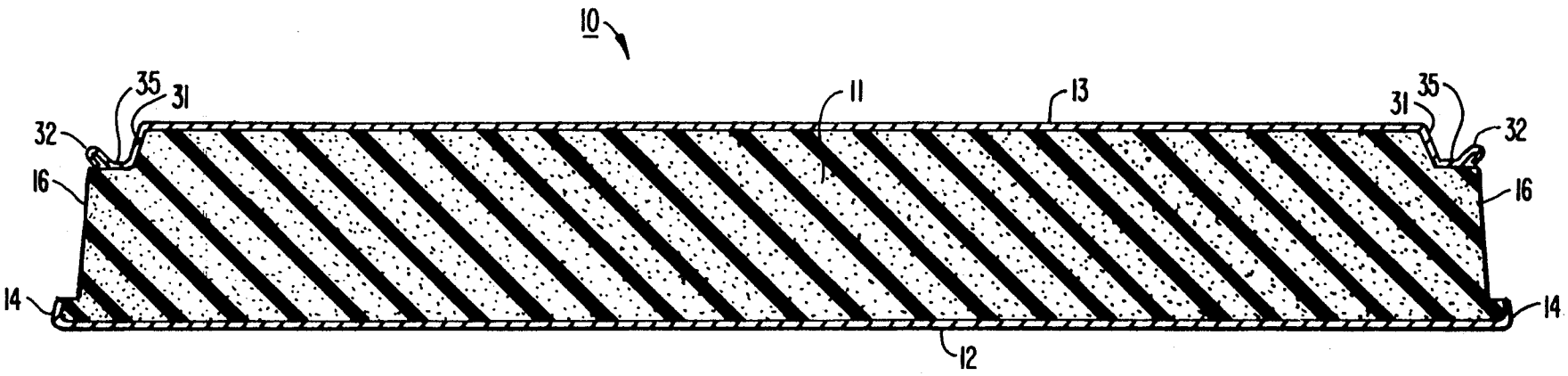

Turning to FIG. 1, a cross-sectional view of the composite foam panel typical of the present invention is provided. The panel 10 consists of structural foam core 11 bonded to interior metal skin 12 and exterior metal skin 13. The bond between the exterior and interior metal skins, on the one hand, and the structural foam core, on the other, can be created by curing the foam core in contact with the metal skins or by adhesive bonding the elements together.

Inner metal facing sheet 12 is characterized as having a width "A" of specific dimension defined by two parallel edges. Ideally, each edge displays a lip 14 composed of inner metal facing sheet turned upwardly and toward the outer metal facing sheet.

Outer metal facing sheet 13 is also characterized as having a width shown as "B" in FIG. 1 as defined by two parallel edges. It must be noted that width B is smaller than width A which is a design characteristic of the present invention, the utility of which will be more readily apparent in the following discussion.

The profile of the side edges of the outer metal facing sheet can be of virtually any configuration to facilitate engagement with the exterior joint cover, the purpose of which will be discussed hereinafter. However, as an example of a typical configuration, and as a preferred embodiment, reference is made to FIG. 1 wherein outer metal facing sheet 13 is provided with a first segment 31 composed of outer metal facing sheet material bent forward inner metal facing sheet 12. Second segment 35 is bent substantially parallel to inner metal facing sheet 12 while third segment 32 is bent away from inner metal facing sheet 12 to form a substantially u-shaped member.

Structural foam core 11 is generally characterized as possessing top and bottom surfaces which are defined and which are adhesively connected to outer metal and inner metal facing sheets 13 and 12, respectively. The structural foam core 11 further possesses a width at its top surface which is substantially coincident with width B which, is noted previously, is the width of the outer metal facing sheet. The bottom surface of structural foam core 11 is substantially coincident with width A, the width of inner metal facing sheet 12. As such, in gross appearance, the side walls of individual structural foam core member 11 slopes diagonally and outwardly from top to bottom.

Figure 2:
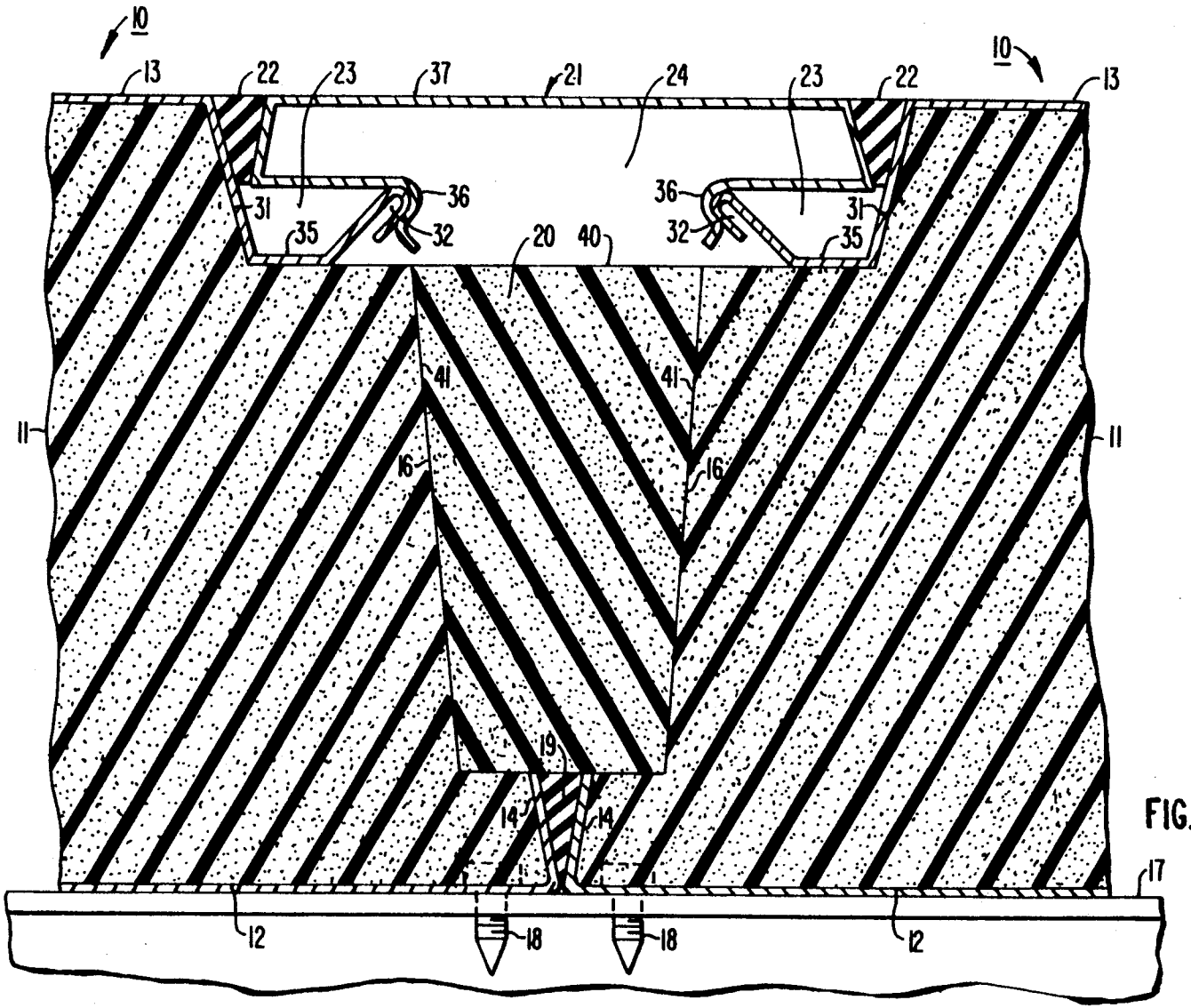

As a preferred embodiment, the side edge or profile of structural foam core 11 is configured as shown, in detail, as in FIG. 2. More specifically, structural foam core 11 is provided with the profile defined by the first and second segments 31 and 35 of outer metal facing sheet 13, a substantially straight edge 16 preceding toward the inner metal facing sheet 12, terminating substantially at a distance from the inner metal facing sheet as defined by lips 14. At that point, the profile extends towards the lip edge of inner metal facing sheet 12.

As noted by viewing FIG. 2, the building panel of the present invention is created by abutting two or more individual panel members substantially at the parallel edges of their inner metal facing sheets. Ideally, lips 14 are created which form somewhat of a "V" between adjacent members. The panel members can be fastened to any appropriate substantially planar support through the use of securing means 18, such as screw members which pass through the inner metal facing sheet in an area approximate the parallel edges thereof.

The space which is formed between lips 14 can be substantially filled with a joint sealant 19 such as silicone caulking. This substantially prevents the passage of water through this abutment seam and creates a substantially waterproof member.

After the attachment of the panel members has been made to the supporting structure, foam plug 20, having top surface 40 and sloping side walls 41 as defined by the slope of structural foam core members 11 at edges 16 is inserted. It is contemplated that a slightly oversized plug 20 is to be employed so that it may be wedged tightly between adjacent panel members. As is quite evident, this plug resides over attachment means 18 to enhance the thermal insulating properties of the assembly. In addition, the plug can be readily removed thus exposing attachment means 18 in the event that individual panel members must be removed from the structural side wall and replaced.

After foam plug 20 is inserted, exterior joint cover 21 is installed. The exterior joint cover can be of virtually any configuration having a top exterior surface and side edges sized such that its side edges engage the edges of outer metal facing sheets of adjacent panel members. When the outer metal facing sheets are provided with profiles as shown in the appended figures, the exterior joint cover is sized such that s-shaped segments 36 frictionally fit over u-shaped members 32 of adjacent panel members. In installing exterior joint cover 21, top exterior surface 37 is substantially parallel to outer metal facing sheet 13.

For roof applications, it is contemplated that the space formed between first segment 31 of outer metal facing sheet 13 and at least a segment of the interior leg portions of exterior joint cover 21 be substantially filled with joint sealant 22 capable of substantially preventing the passage of water therethrough. Obviously, for wall applications, sealant 22 can be eliminated.

It can be visually appreciated from viewing FIG. 2 that the insulating value of the panel assembly is maintained by providing foam plug 20 as there is no metal part in the fastening system to bridge between the exterior and interior surfaces. As such, the design of the present invention provides minimal thermal leakage through the joint. This is achieved while providing a ready access for panel removal for, as noted previously, panels can be removed by simply removing joint cover 21 and foam plug 20 to gain access to fastening elements 18. Since both structural foam core 11 and exterior and interior metal facing sheets 13 and 12 are not interlocking at the side joints, erection can be done in any direction and in any sequence.

In the preferred embodiment, in the event that sealants 19 and 22 are not employed or, if they are employed but are imperfect, cavities 23 are formed between joint cover 21 and the first, second and third segments, 31, 35 and 32, respectively of outer facing sheet 13. Generally, cavities 23 are open to the external environment at their ends so that free space 23 is at substantially ambient pressure. Similarly, cavity 24 which is formed between exterior joint cover 21, third segment 32, structural foam core 11 and foam plug 20 is open to the external environment and thus at ambient pressure.

These cavities, in particularly, cavities 23 are used for water path control. In wall applications, cavities 23 act as downspouts directing exterior rain water to drain downwardly preventing the water from entering into cavity 24. In roofing applications, cavities 23 act as gutters directing any water which may have infiltrated through sealant 22 to flow to the eves of the roof. Since cavities 23 are pressure equalized to the exterior air, only a small amount of water is expected to get into these cavities under imperfect sealant conditions. Therefore, there is little or no concern of overflow in cavities 23.

Cavity 24 should generally be dry under normal conditions and it is this cavity which is connected to the interior side joint through the contacting surface between foam plug 20 and structural foam core 11. As such, any imperfection in interior sealant 19 is likely to only produce air leakage without water leakage problems. In the event that a joint gap must be adjusted according to the dimensional tolerance of the building, foam plug 20 can be reshaped to provide a tight fit without substantial reworking of individual panel members. It is noted that most foam products are highly compressible and, as such, an oversized foam plug 20 can tolerate a range of joint gap variations without reshaping. As such, the objectives of providing a thermally tight side joint and maintaining the adjustability for erection tolerance is achievable only in the practice of the present invention.

Throughout this discussion, various facing sheets and joint covers have been referred to as being composed of metal. Broadly, it is contemplated that these sheets can be commonly painted carbon steel, aluminum or stainless steel. It is further contemplated that the invention employ metal facing materials ranging from approximately 0.013 inches to 0.036 inches although the functionality of the present invention is not deemed to be at all limited by these dimensions.

What is claimed is:

1. A building panel assembly comprising panel members, said members comprising an outer metal facing sheet forming an exterior panel surface, an inner metal facing sheet forming an interior panel surface, and a structural foam core, said inner metal facing sheet being characterized as having a width of specific dimension defined by two parallel edges, said outer metal facing sheet being also characterized as having a width defined by two parallel edges which is less than the width of said inner metal facing sheet, said structural foam core being characterized as having substantially parallel top and bottom surfaces adhesively connected to said outer metal and inner metal facing sheets and being further characterized wherein said top surface is of a width substantially coincident with the width of said outer metal facing sheet and said bottom surface is of a width substantially coincident with the width of said inner metal facing sheet such that said structural foam core possesses sloping side walls and wherein said panel members abut approximately at the parallel edges of adjacent inner metal facing sheets, a foam plug having a top surface and sloping side walls frictionally engaging the sloping side walls of the structural foam cores of adjacent panel members and an exterior joint cover covering over the top surface of said foam plug and contacting said outer metal facing sheets of adjacent panel members.

2. The building panel assembly of claim 1 wherein said edge of said inner metal facing sheet displays a lip of the inner metal facing sheet turned upwardly and toward said outer metal facing sheet.

3. The building panel assembly of claim 2 wherein said panel members are placed upon a substantially planar support and attached thereto by securing means through said inner metal facing sheet in an area approximate said parallel edges thereof.

4. The building panel assembly of claim 2 wherein a space is formed between the lips of said edge of said inner metal facing sheets, said space being substantially filled with a joint sealant capable of substantially preventing the passage of water therethrough.

5. Panel members for creating a building panel assembly, said members comprising an outer metal facing sheet forming an exterior panel surface, an inner metal facing sheet forming an interior panel surface, and a structural foam core, said inner metal facing sheet being characterized as having a width of specific dimension defined by two parallel edges, said outer metal facing sheet being also characterized as having a width defined by two parallel edges which is less than the width of said inner metal facing sheet, each edge of said outer metal facing sheet having a first segment of outer metal facing sheet bent toward said inner metal facing sheet, a second segment bent substantially parallel to said inner metal facing sheet and a third segment bent away from said inner metal facing sheet to form a substantially u-shaped member, said structural foam core being characterized as having substantially parallel top and bottom surfaces adhesively connected to said outer metal and inner metal facing sheets and being further characterized wherein said top surface is of a width substantially coincident with the width of said outer metal facing sheet and said bottom surface is of a width substantially coincident with the width of said inner metal facing sheet such that said structural foam core possesses sloping side walls.

6. The panel members of claim 5 wherein said each edge of said inner metal facing sheet displays a lip of the inner metal facing sheet turned upwardly and toward said outer metal facing sheet.

7. Panel members of claim 5 wherein the structural foam core is provided with a profile defined by the first and second segments of the outer metal facing sheet, a substantially straight edge preceding toward the inner metal facing sheet terminating substantially at a distance from the inner metal facing sheet as defined by said lip of the inner metal facing sheet and extending toward the lip edge of said inner metal facing sheet.

8. A building panel assembly comprised of abutting individual panel members of claim 6 approximately at the lips at the inner metal facing sheets, a foam plug frictionally engaging the sloping side walls of the structural foam cores of adjacent panel members and an exterior joint cover characterized as having a top exterior surface and interior leg portions terminating as substantially s-shaped segments, said exterior joint cover being sized such that s-shaped segments frictionally fit over u-shaped members of adjacent panel members whereby said top exterior surface is substantially parallel to said outer metal facing sheet.

9. The building panel assembly of claim 4 wherein said panel members are placed upon a substantially planar support and attached thereto by securing means through said inner metal facing sheet in an area approximate said parallel edges thereof.

10. The building panel assembly of claim 6 wherein a space is formed between the lips of said two or more abutting individual panel members, said space being substantially filled with a joint sealant capable of substantially preventing the passage of water therethrough.

11. The building panel assembly of claim 8 wherein a space is formed between said first segment of said outer metal facing sheet and at least a segment of the interior leg portions of said interior joint cover, said space being substantially filled with a joint sealant capable of substantially preventing the passage of water therethrough.

12. The building panel assembly of claim 8 wherein a space if formed between said first, second and third segments of said outer facing sheets and said interior leg portions of said exterior joint cover, said space being substantially at ambient pressure.

13. The building panel assembly of claim 8 wherein a space is formed between said exterior joint cover, said third segment of said outer facing sheets, said foam core and foam plug, said space being substantially at ambient pressure.

14. A building panel assembly comprising two or more individual panel members, said members comprising an outer metal facing sheet forming an exterior panel surface, an inner metal facing sheet forming an interior panel surface and a structural foam core, said inner metal facing sheet being characterized as having a width of specific dimension defined by two parallel edges, said outer metal facing sheet being characterized as having a width defined by two parallel edges which is less than the width of said inner metal facing sheet, each edge of said outer metal facing sheet having a first segment of the outer metal facing sheet bent toward said inner metal facing sheet, a second segment bent substantially parallel to said inner metal facing sheet and a third segment bent away from said inner metal facing sheet to form a substantially u-shaped member, said structural foam core being characterized as having substantially top and bottom surfaces adhesively connected to said outer metal and inner metal facing sheets and being further characterized wherein said top surface is of a width substantially coincident with the width of said outer metal facing sheet and said bottom surface is of a width substantially coincident with the width of said inner metal facing sheet such, that said structural foam core possesses sloping side walls, abutting said individual panel members substantially at the edges of the inner metal facing sheets, a foam plug frictionally engaging its sloping side walls with the sloping side walls of the structural foam cores of adjacent panel members and an exterior joint cover characterized as having a top exterior surface and interior leg portions terminating in substantially s-shaped segments, said exterior joint cover being sized such that said s-shaped segments frictionally fit over u-shaped members of adjacent panel members whereby said top exterior surface is substantially parallel to said outer metal facing, sheet.

15. The building panel assembly of claim 14 wherein each edge of said inner metal facing sheet displays a lip of the inner metal facing sheet turned upwardly towards said outer metal facing sheet.

16. The building panel assembly of claim 14 wherein said panel members are placed upon a substantially planar support and are attached thereto by securing means passing through said inner metal facing sheet in an area approximate said parallel edges thereof.

17. The building panel assembly of claim 15 wherein a space is formed between the lips of said two or more abutting individual panel members, said space being substantially filled with a joint sealant capable of substantially preventing the passage of water therethrough.

18. The building panel assembly of claim 15 where a space is formed between said first segment of said outer metal facing sheet and at least a segment of the interior leg portions of said exterior joint cover, said space being substantially filled with a joint sealant capable of substantially preventing the passage of water therethrough.

19. The building panel assembly of claim 15 wherein a space is formed between said first, second and third segments of said outer facing sheets and said interior leg portions of said interior joint cover, said space being substantially at ambient pressure.

20. The building panel assembly of claim 15 wherein a space is formed between said exterior joint cover, said third segment of said outer facing sheets, said foam core and foam plug, said space being substantially at ambient pressure.

21. The building panel assembly of claim 15 wherein the structural foam core is provided with a profile defined by the first and second segments of the outer facing sheet, a substantially straight edge proceeding toward the inner metal facing sheet terminating substantially at a distance from the inner metal facing sheet as defined by said lip of the inner metal facing sheet and extending toward the lip edge of said inner metal facing sheet.

* * * * *